United States Patent [19]

Yang

[11] Patent Number: 4,951,695

[45] Date of Patent: Aug. 28, 1990

[54] ANTI-SLIPPING TELESCOPIC CENTERPOST OF MULTIPLE-FOLD UMBRELLA

[76] Inventor: Chi-Kuo Yang, P.O. Box 10160, Taipei, Taiwan

[21] Appl. No.: 442,918

[22] Filed: Nov. 29, 1989

[51] Int. Cl.[5] ..... A45B 19/00

[52] U.S. Cl. ..... 135/25 R; 135/39; 135/28

[58] Field of Search ..... 135/39, 41, 37, 38, 135/28, 25 R, 25 A, 26

[56] References Cited

U.S. PATENT DOCUMENTS

| | | | |
|---|---|---|---|
| 3,856,032 | 12/1974 | Schafer | 135/38 X |
| 3,921,655 | 11/1975 | Weber | 135/28 X |

FOREIGN PATENT DOCUMENTS

| | | | |
|---|---|---|---|
| 1281645 | 10/1968 | Fed. Rep. of Germany | 135/25 R |
| 2227946 | 7/1973 | Fed. Rep. of Germany | 135/25 R |
| 2422209 | 11/1975 | Fed. Rep. of Germany | 135/25 R |
| 1235392 | 5/1960 | France | 135/39 |
| 580574 | 8/1958 | Italy | 135/25 R |
| 409119 | 4/1934 | United Kingdom | 135/38 |

*Primary Examiner*—David A. Scherbel
*Assistant Examiner*—Lan Mai

[57] ABSTRACT

A telescopic centerpost includes a slider of umbrella spokes or ribs formed with a catch socket engageable with a stabilizing retainer for preventing an accidental dropping of the slider and preventing an unexpected closing of umbrella canopy or cloth once opened; and having a handle tube of the centerpost formed with a plurality of longitudinal extensions on an outer circumference of the handle tube for firmly gripping the handle tube for preventing its slipping.

9 Claims, 2 Drawing Sheets

ANTI-SLIPPING TELESCOPIC CENTERPOST OF MULTIPLE-FOLD UMBRELLA

BACKGROUND OF THE INVENTION

A conventional telescopic centerpost of a multiple-fold umbrella as shown in FIGS. 1 and 2 comprises an arcuate spring plate A having an upper catch C supporting a slider or runner S of umbrella spokes or ribs R of an umbrella canopy or cloth, and a plurality of cylindrical tubes telescopically connected with one another. However, such a conventional telescopic centerpost may have the following drawbacks:

1. In order for retractably receiving all the telescopic tubes T1, T2 and T3 into the slider S, the cylindrical hole S1 of the slider S should be made as large as possible and the flange S3 is formed with an arcuate opening S2 for smoothly folding the telescopic tubes, the catch C of the spring plate A may be easily poked into the hole S1 without supporting the flange S3 of the slider S, thereby causing an accidental collapsing action of an open umbrella.

2. Since the arcuate plate A is limited by a coupling catch C1 formed on its lower portion so that the total length of the plate A is quite limited to possibly reduce its resilience as easily causing an elastic fatigue of the spring plate, thereby influencing a folding or extending operation of the umbrella.

3. The upper catch C of the spring plate A is provided for resting the slider S thereon. Upon a depression of the catch C when retracting the umbrella ribs R for closing the umbrella, the outer acute angle of the catch C may easily injure an umbrella user.

4. The round or cylindrical handle tube T4 of the centerpost T may be easily slipped and can not be gripped firmly due to its round surface.

The present inventor has found the drawbacks of a conventional telescopic centerpost and invented the present antislipping telescopic centerpost of a multiple-fold umbrella.

SUMMARY OF THE INVENTION

The object of the present invention is to provide a telescopic centerpost having a slider of umbrella spokes or ribs formed with a catch socket engageable with a stabilizing retainer for preventing an accidental dropping of the slider and preventing the unexpected closing of umbrella canopy or cloth once opened; and having a handle tube of the centerpost formed with a plurality of longitudinal extensions of an outer circumference of the handle tube for firmly gripping the handle tube for preventing its slipping.

DETAILED DESCRIPTION

Figure 1:
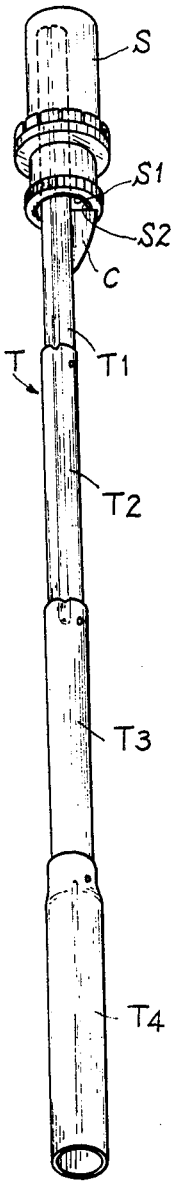
FIG. 1 PRIOR ART
FIG. 1 is a prior art of a conventional telescopic ceterpost of a multiple-fold umbrella.

As shown in FIGS. 3–8, the present invention comprises: a first tube 1 formed on an upper portion of a centerpost of the present invention, a second tube 2 extendibly formed under the first tube 1 and retractably receiving the first tube 1, a third tube 3 extendibly formed under the second tube 2 and retractably receiving the second tube 2, a handle tube 4 formed on a lower portion of the centerpost retractably receiving the third tube 3, a slider 5 for securing ribs or spokes **5*a* of an umbrella canopy or cloth movably jacketed on the first tube 1, and a stabilizing retainer 6 formed on the first tube 1 for stably retaining the slider 5 on the first tube 1. A top notch 12 is formed on an uppermost end portion of the first tube 1 for pivotally securing a plurality of top ribs 121** of the umbrella canopy.

Figure 4:
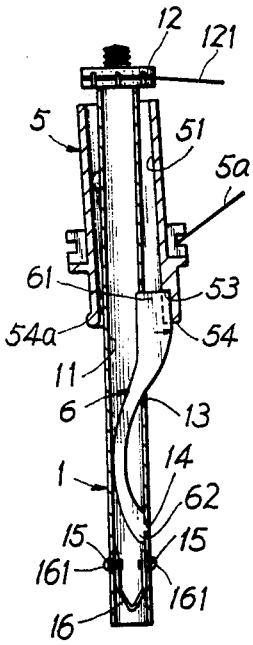
FIG. 4 is a partial sectional drawing showing an upper portion of the present invention.
Figure 3:
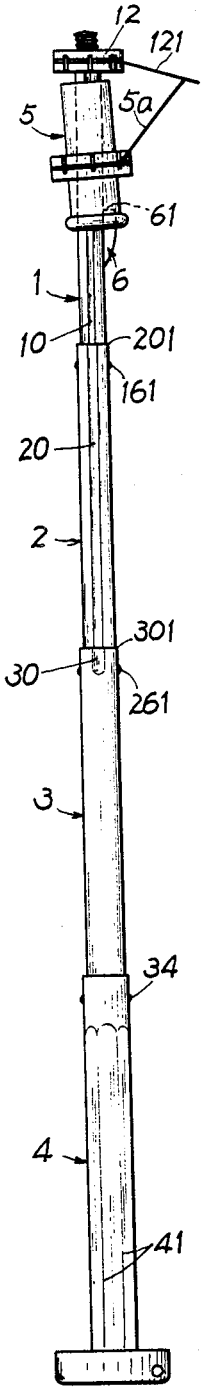
FIG. 3 is an illustration of the present invention when extended.
Figure 5:
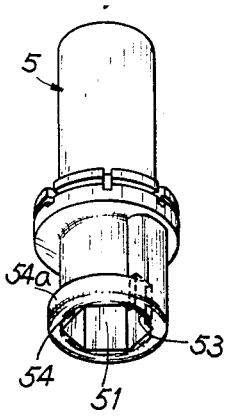
FIG. 5 is a perspective view of a slider of the present invention.

The first tube 1 includes a cylindrical bore portion 11, an upper side slot 13 formed in an upper side portion of the tube 1 for protruding an upper catch 61 of the stabilizing retainer 6, a lower side opening 14 formed on a lower portion of the tube 1 below the upper slot 13 for fixing a lower protrusion 62 of the retainer 6, and a coupling catch 16 generally U-shaped having a pair of coupling protrusions 161 protruding laterally through two holes 15 formed on two opposite sides of the tube 1 and positioned on the lower portion of the tube 1 for coupling a lower second tube 2 as shown in FIGS. 4 and 3. The stabilizing retainer 6 is generally formed as an arcuate spring plate embedded in the cylindrical bore portion 11 in the first tube 1 having the upper catch 61 formed on its upper portion and having the lower protrusion 62 formed on its lower portion.

Figure 2:
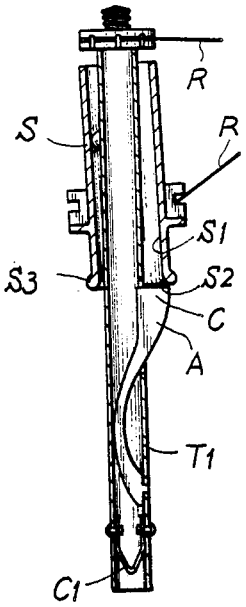
FIG. 2 PRIOR ART
FIG. 2 is a partial sectional drawing of a conventional telescopic centerpost.
Figure 6:
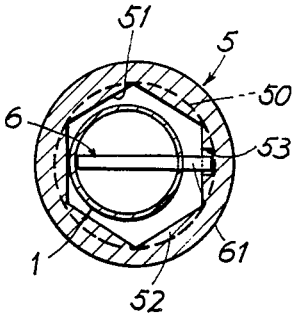
FIG. 6 is a cross-sectional drawing of the slider engaged with a retainer catch of the present invention.

The slider 5 includes a polygonal hole 51 longitudinally through the slider 5, a catch socket 53 recessed radially from a secant wall portion 52 of the polygonal hole 51 for engaging an outer extension 611 of the upper catch 61 of the retainer 6, and an annular flange **54*a* formed on a lowest perimeter of the slider 5 defining an arcuate opening 53 therein. As shown in FIG. 6, an inferential circle 50 of dotted line is drawn in the slider 5, which is intended to simulate a cylindrical bore portion or socket S1 of a conventional slider S as shown in FIGS. 1 and 2, and which socket S1 is so large to be easily slipped from a supporting surface of an upper catch C of the spring plate A, thereby easily causing an unexpected collapsing of an umbrella. However, in view of the solid line of the present invention as shown in FIG. 6, the secant wall portion 52 between a polygonal bore portion 51 and an outer circumference of the slider 5 defines a thicker area for forming such a catch socket 53 recessed in the secant wall portion 52 for a more stable engagement between the catch 61 and the slider 5 for stabilizing an extended or opening umbrella. The resilience of the catch 61 caused by the arcuate spring plate of the retainer 6 will resiliently urge and stably engage the socket 53 of the slider 5**, preventing an unexpected collapsing of the umbrella as opened. The polygonal bore portion may be a hexagonal or octagonal and is preferable a hexagonal shape.

For coupling and connecting the second tube 2 and third tube 3, another catch having protrusions 261 is provided for their connection. All the tubes 1, 2, 3, 4 are made as hollow tubes for their mutual telescopic operation. Each tube is formed with a longitudinal groove 10, 20 or 30 therein so that the tubes 1, 2, 3 can be telescopically retracted or extended without twisting or rotation. The arcuate opening 53 of the slider 5 will slidably receive the lower tubes 2, 3 by smoothly passing the upper edges 201, 301 of the tubes 2, 3 when folding the telescopic tubes of the centerpost.

Figure 8:
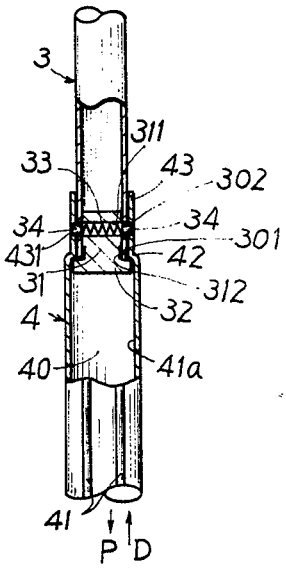
FIG. 8 is a partial sectional drawing showing a connection between the handle tube and a telescopic tube next to the handle tube of the present invention.
Figure 9:
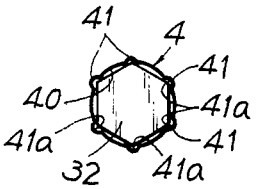
Figure 7:
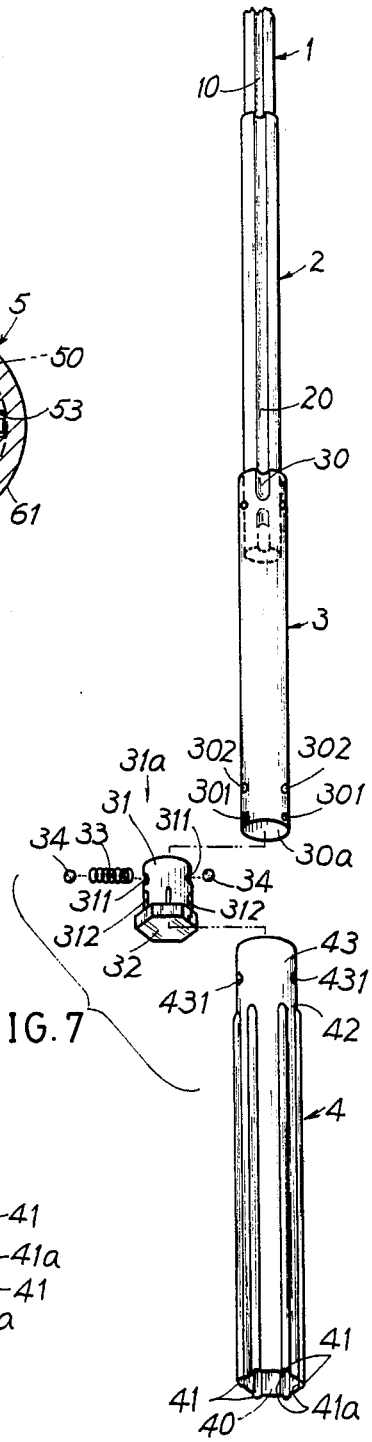
FIG. 7 shows a bottom plug for connecting a handle tube to the remaining telescopic tubes of a centerpost of the present invention.

As shown in FIGS. 7 and 8, a bottom plug 31*a* is secured to a bottom portion of the third tube 3 for coupling a handle tube 4 of the present invention. The bottom plug 31*a* includes: a cylinder portion 31 snugly fixed into a cylindrical hole 30*a* in the third tube 3 by fixing insert (not shown) through holes 301 formed in a lower portion of the third tube 3 and through hole 312 formed in the cylinder portion 31, a polygonal flange 32 preferably shaped as a hexagonal flange secured on a lower portion of the cylinder portion 31 having a diagonal width larger than a diameter of the cylinder portion 31, a tension spring 33 inserted through a transverse hole 311 laterally formed in the cylinder portion 31 for urging two protrusion balls 34 laterally to couple the third tube 3 with the handle tube 4 by passing through two ball holes 302 formed in the lower portion of the third tube 3 and two ball holes 431 formed in an upper portion of the handle tube 4.

The handle tube 4 includes: a plurality of longitudinal extensions 41 polygonally formed on a hollow cylindrical wall 40 each longitudinal extension 41 defining a longitudinal groove 41*a* inside the cylindrical wall 40 for slidably guiding the poygonal flange 32 of the bottom plug 31*a*, an upper cylindrical tube portion 43 contacted from the lower cylindrical wall 40 to define an intermediate contraction portion 42 between the cylindrical wall 40 and the upper tube portion 43 to be limited by the flange 32 when pulling the handle tube 4 (direction P as shown in FIG. 8) when extending the ceterpost. For folding the umbrella, the handle tube 4 is depressed in direction D to push the handle tube 4 upwardly for retractably receiving the third tube 3 in the tube 4 by smoothly engaging the longitudinal grooves 41*a* with the polygonal flange 32. The polygonal flange is preferably shaped as a hexagonal flange and the longitudinal extensions 41 (grooves 41*a*) are preferably hexagonally disposed on the cylindrical wall 40.

The present invention has the following advantages superior to a conventional telescopic centerpost of an umbrella:

1. The upper catch 61 of the retainer 6 is stably resiliently engaged with the socket 53 formed in the slider 5 for preventing an unexpected collapsing of umbrella ribs and canopy when opened.

2. The catch extension 611 as engaged with the socket 53 is concealed in slider 5, without causing injury to any umbrella user.

3. The upper catch 61 is protruded upwardly to engage the socket 53 deeply recessed inside the slider 5 so that a total length of the arcuate spring plate of the retainer 6 can be prolonged to have a better elasticity.

4. The polygonal longitudinal extensions 41 formed on the handle tube 4 may prevent a slipping when gripping the umbrella handle.

I claim:

1. A telescopic centerpost of multiple-fold umbrella comprising:

a plurality of hollow tubes telescopically retracted or extended with one another having a slider for securing spokes or ribs of an umbrella canopy extendibly retained on an upper portion of the centerpost and a handle tube formed on a lower portion of the centerpost, a stabilizing retainer generally formed as an arcuate spring plate held in a first hollow tube of the hollow tubes having an upper catch protruding laterally through a side slot formed in said first tube, and a bottom plug fixed on a bottom portion of a lower hollow tube for limitingly coupling the handle tube with the lower hollow tube;

the improvement which comprises:

said slider including a polygonal bore portion formed inside said slider and a catch socket recessed radially in a secant wall portion adjacent to said polygonal bore portion and recessed upwardly from an arcuate opening of an annular flange formed on a lowest perimeter of said slider, said catch socket operatively engageable with said upper catch of said stabilizing retainer for preventing an unexpected collapsing of the slider and the canopy when opened.

2. A telescopic centerpost of multiple-fold umbrella according to claim 1, wherein said polygonal bore portion of said slider is a hexagonal bore portion.

3. A telescopic centerpost of multiple-fold umbrella according to claim 1, wherein said catch socket of said polygonal bore portion is positioned heigher than said arcuate opening of said flange of said slider.

4. A telescopic centerpost of multiple-fold umbrella according to claim 1, wherein said bottom plug includes a cylinder portion formed on an upper portion of said plug fixed in a cylindrical hole in the lower hollow tube and a polygonal flange secured under said cylinder portion slidably engageable with a plurality of longitudinal grooves polygonally formed in a cylindrical wall of said handle tube.

5. A telescopic centerpost of multiple-fold umbrella according to claim 4, wherein said polygonal flange is a hexagonal flange having a diagonal width larger than a diameter of said cylinder portion of said bottom plug.

6. A telescopic ceterpost of multiple-fold umbrella according to claim 4, wherein said handle tube includes a plurality of longitudinal extensions polygonally disposed on said cylindrical wall of said handle tube having each said longitudinal extension defining each said longitudinal groove slidably engageable and smoothly guiding each angle of said polygonal flange of said bottom plug.

7. A telescopic centerpost according to claim 6, wherein said longitudinal extensions and grooves are hexagonally disposed on said cylindrical wall of said handle tube.

8. A telescopic centerpost according to claim 6, wherein said handle tube has said cylindrical wall of said plurality of longitudinal grooves slightly enlarged from an upper cylindrical tube portion of said handle tube so that said upper cylindrical tube portion of said handle tube engageably receives the lower hollow tube and the cylindrical wall of said handle tube below said upper cylindrical tube portion slidably engages said polygonal flange of said bottom plug for a smoothly folding or extending operation of the telescopic centerpost.

9. A telescopic centerpost according to claim 6, wherein said bottom plug secured in said lower hollow tube further includes a transverse hole for inserting a tension spring therein for urging a pair of protrusion balls laterally outwardly to pass a pair of ball holes formed in a lower portion of said lower hollow tube and pass a pair of second ball holes formed in an upper portion of said handle tube for resiliently coupling said lower hollow tube with said handle tube.

* * * * *